US006533045B1

(12) United States Patent
Cooper

(10) Patent No.: US 6,533,045 B1
(45) Date of Patent: Mar. 18, 2003

(54) PORTABLE DRILLING RIG

(76) Inventor: Jack M. Cooper, Box 728, Oxford, KS (US) 67119

( * ) Notice: Subject to any disclaimer, the term of this patent is extended or adjusted under 35 U.S.C. 154(b) by 0 days.

(21) Appl. No.: 09/847,269

(22) Filed: May 2, 2001

(51) Int. Cl.[7] ..... E21B 7/02

(52) U.S. Cl. ..... 173/28; 173/187; 173/185; 175/85; 175/122

(58) Field of Search ..... 173/187, 185, 173/28, 85, 122

(56) References Cited

U.S. PATENT DOCUMENTS 2,665,116 A * 1/1954 Brink ..... 173/150
4,371,041 A * 2/1983 Becker et al. ..... 173/147
4,496,006 A * 1/1985 Smith ..... 173/184
6,257,349 B1 * 7/2001 Bardwell ..... 173/147

* cited by examiner

*Primary Examiner*—David Bagnell
*Assistant Examiner*—Robert Jones
(74) *Attorney, Agent, or Firm*—Molly D. McKay

(57) ABSTRACT

A portable drilling rig 20 for drilling water wells or installing geothermal pipe systems in the ground 22. The portable drilling rig 20 is removably mounted on a truck bed 24. The single I beam mast 30 of the rig 20 pivots to a horizontal position 32 on the truck bed 24 for transport and pivots to a vertical position 34 for drilling, or alternately, pivots to a slanted position 38 for drilling at an angle "A" into the ground 22. A swivel 78 that is normally parallel to the mast 30 is movable along the length of the mast 30. The swivel 78 can be pivoted to its non-parallel position 122 relative to the mast 30 in order to attach or remove pipe segments 126 from a drive shaft 136 provided on the swivel 78.

13 Claims, 9 Drawing Sheets

PORTABLE DRILLING RIG

BACKGROUND OF THE INVENTION

1. Field of the Invention

The present invention relates to a portable drilling rig for drilling water wells or installing geothermal pipe systems in the ground. More specifically, the present invention is a portable drilling rig that is removably mounted on a truck bed. The rig pivots to a horizontal position on the truck bed for transport and pivots to a vertical position for drilling, or alternately, pivots to a slanted position for drilling at an angle into the ground.

2. Description of the Related Art

Currently the drilling rigs that are used to drill water wells or to install underground piping for use in geothermal heating and cooling installations are large and can not be easily driven into a small area, such as a back yard of an urban residence.

Also, current drilling rigs are not constructed to allow the drive shaft that rotates the pipe drill string and drill bit to pivot so that additional pipe segments can be easily added to the pipe drill string, or alternately, removed from the pipe drill string.

Further, most current drill rigs are not simple enough for a single person to operate.

Finally, other drill rigs are permanently mounted to the vehicle on which they are transported, making the vehicle unsuitable for any other purpose.

The present invention addresses each of these problems by providing a drilling rig that is small and is removably mounted to the bed of a truck. The drilling rig of the present invention is designed with a pivoting swivel that allows a single operator to easily operate the rig to drill a well.

SUMMARY OF THE INVENTION

The present invention relates to a portable drilling rig for drilling water wells or installing geothermal pipe systems in the ground. More specifically, the present invention is a portable drilling rig that is removably mounted on a truck bed via a supporting frame that holds the rig on the truck bed. The rig is provided with a pivotal mast that can be pivoted downward to a horizontal position for transport and can be pivoted upward to a vertical position to drill a vertical bore into the ground, or alternately, pivoted upward to a slanted, off-vertical position for drilling an angled bore into the ground.

The mast is pivotally secured to an upwardly extending, supporting pivot leg provided secured to the frame at the rear end of the rig. The mast is raised and lowered by a first hydraulic cylinder that causes the mast to pivot at the supporting pivot leg. When the mast is pivoted downward to its horizontal position, the upper end of the mast is supported by an upwardly extending, front support leg secured to the frame at the front of the frame.

Both the support pivot leg and the front support leg are secured in their upright positions by braces that extend downward and secure to the bottom members of the frame at angles, thus forming triangular bracing with the bottom members of the frame for the legs. Also the bottom members of the frame attach to a double I-beam of the frame located at the rear end to form triangular configurations with the double I-beam. The triangular configurations of the bottom members and the braces of the frame make it strong. A base plate is secured to the double I-beam of the frame at the rear end so that the base plate extends horizontally away from the frame. The base plate has a rectangular bit breaker opening therethrough and a removable plate that attaches over the base plate via bolts. The removable plate has a circular shoe opening extending through it. The function of the base plate and the removable plate will be discussed more fully hereafter.

Also, jacks attach to the lower side of the double I-beam. The jacks can be lowered to the ground to help support the frame above the ground either when the rig is being used for drilling or when the rig is removed from the truck bed. The jacks can be retracted upward toward the frame when the rig is being transported so that they do not drag on the ground.

A swivel is movably attached to the back side of the mast via a pair of mast chains so that the swivel can be moved upward on the mast and lowered downward on the mast when the mast is raised from its horizontal position. One of the two ends of each of the mast chains secures to a top of a non-pivoting portion of the swivel and the other end of each of the mast chains secures to a bottom of the non-pivoting portion of the swivel. Each of the mast chains extends over a mast chain sprocket at the upper end of the mast and each of the mast chains extends around a mast drive sprocket at the lower end of the mast. The mast chain sprockets provided at the upper end of the mast secure to the mast via a common shaft, and the mast drive sprockets at the lower end of the mast secure to the mast via a common shaft. A pair of mast chain drive motors provided on the lower end of the mast rotate the mast drive sprockets via a pair of mast motor drive chains, thus raising and lowering the swivel.

A boom line arm is also pivotally secured to the mast on the upper end of the mast. The boom line arm pivots to a horizontal position when the mast is in its horizontal position, and can be pivoted to a perpendicular position so that the boom line extends outward from the rear end of the rig when the mast is raised from its horizontal position. The boom line arm is provided with a pulley around which a boom cable runs. The boom arm cable removably attaches on one end to a hydraulic winch provided attached to the frame and attaches on an opposite end to the swivel. The winch is activated to pivot the swivel by raising the swivel to a position that is non-parallel with the mast, and alternately, to lower the swivel back to its original position so that it is parallel with the mast. It is necessary to pivot the swivel upward out of alignment with the mast in order to add pipe segments to the bottom end of the swivel when making up a pipe drill string of pipe during drilling operations and also to remove pipe segments from the bottom end of the swivel when pulling and dismantling a pipe drill string.

The swivel is provided with dual swivel drive sprockets at its top end. The dual swivel drive sprockets are secured to a drive shaft via a key that fits into a keyway in the drive shaft. The drive shaft extends from the top end of the swivel, through the swivel, and to the bottom end of the swivel. The dual swivel drive sprockets are driven by two swivel drive motors via a pair of swivel drive chains. Each of the swivel drive chains engages its associated swivel drive sprocket and a drive sprocket provided on its associated swivel drive motor to cause the drive shaft to rotate within the swivel when the rig is being used to drill.

The swivel is provided with bearings adjacent to the dual swivel drive sprockets and the drive shaft rotates within the bearings. The bearings attach to a supporting collar that secures to a pivoting member. The main body of the swivel also attaches via a support arm to the pivoting member to hold the swivel stationary relative to the pivoting member.

The pivoting member pivotally attaches via a pivot rod to the non-pivoting portion of the swivel. The pivoting member and the attached swivel, as a unit, pivot at the pivot rod to move the swivel out of parallel alignment with the mast, and alternately, back into parallel alignment with the mast, as previously described. The bearings are retained on the drive shaft by a shoulder provided on the drive shaft at one end of the collar and by a threaded nut on the other end of the collar. The threaded nut engages threads provided on the drive shaft on a portion of the drive shaft located adjacent to the dual swivel drive sprockets.

The drive shaft extends through a main body of the swivel that is located adjacent to the supporting collar and bearings. The main body is comprised of a hollow central cylinder to which an end flange attaches at either end of the central cylinder via lock bolts. The end flanges fit tightly within the central cylinder and an o-ring provided in a o-ring groove in each of the end flanges prevents drilling fluid from exiting the hollow central cylinder by preventing fluid from travelling between the end flange and the central cylinder.

Each end flange has a drive shaft opening in it within which the drive shaft extends. Several gland packing rings are provided internally in the main body adjacent to each of the end flanges. A brass ring is provided adjacent to each set of gland packing rings. Each brass ring secures to the drive shaft via screws so that the gland packing rings are sandwiched between their end flange and their associated brass ring. The distance between a brass ring and its associated end flange can be decreased by tightening the lock bolts in order to compress the gland packing rings so that they tighten around the drive shaft. The gland packing rings prevent drilling fluid from exiting the main body via the drive shaft openings in the end flanges.

The central cylinder is provided with an inlet opening for admitting drilling fluid into the hollow main body of the swivel. The drive shaft is provided with several fluid openings that communicate through the drive shaft. The fluid openings are provided in a portion of the drive shaft that is located within the hollow main body of the swivel. Each of these fluid openings extends through the drive shaft into a hollow segment of the drive shaft. The hollow segment of the drive shaft is continuous with the lower end of the drive shaft so that the drive shaft is hollow as it terminates at the bottom end of the swivel. The lower end of the drive shaft is provided with male threads for removable engagement with mating female threads provided on segments of drill pipe. Thus, drilling fluid flows into the hollow main body of the swivel via the inlet opening, then into the hollow segment of the drive shaft via the fluid openings in the drive shaft, and from there into the hollow interior of the pipe segments comprising the pipe drill string.

When the drilling rig is placed in a slanted position so that it can be used to drill an angled bore into the ground, a guide plate is removably secured to the lower end of the mast. The guide plate extends around the pipe drill string to help support the pipe drill string and hold it at the proper angle relative to the ground when drilling an angled bore.

When the drilling rig is placed in its vertical position so that it can be used to drill a vertical bore into the ground, a specially designed guide shoe is placed around the pipe drill string. Two halves of the guide shoe swing opens to facilitate attaching and removing it from the pipe drill string. The guide shoe has a downwardly extending lip that inserts within the shoe opening provided in the base plate, thus allowing the base plate to help keep the pipe drill string in approximately vertically alignment during drilling. The shoe opening is provided in a removable plate attached via bolts to the base plate. The removable plate can be removed to reveal a bit breaker opening, as will be discussed hereafter.

Pipe segments of the pipe drill string must be broken apart from each other to either add pipe to the pipe drill string or to remove pipe from the pipe drill string. In order to break the pipe segments apart, the guide shoe is first removed from the pipe drill string. Next, a backup wrench is inserted around the drill pipe so that the u-shaped head end of the backup wrench engages a flat portion on the end of the drill pipe. A downwardly extending lip provided on the specially designed backup wrench is next inserted into the shoe opening in the base plate. Then a traditional pipe-breaking wrench is employed to grasp a portion of the adjacent pipe. In order for the operator to handle a heavy traditional pipe-breaking wrench, a pulley is provided on the front side of the mast and a cable runs through the pulley. One end of the cable removably attaches to the winch that is attached to the frame and an opposite end of the cable removably attaches to the traditional pipe breaking wrench to assist the operator in lifting, positioning and holding the heavy pipe breaking wrench. One winch can be used for both holding the traditional pipe breaking wrench and for pivoting the swivel upward if the cables are removably attachable to either the winch or to both the traditional pipe breaking wrench and the swivel. Alternately, two separate winches may be employed.

A cable that attaches to a second hydraulic cylinder can be attached to the traditional pipe-breaking wrench in order to provide the necessary torque to break the pipes apart so that they can be unthreaded from each other.

When it is necessary to remove the drilling bit from the pipe drill string, the removable plate is removed from the base plate to reveal the bit breaker opening provided in the base plate. The bit breaker opening is employed for holding a bit breaker. The bit breaker is used to hold the bit so that it does not rotate relative to the base plate. This is necessary when the bit is disengaged from the pipe drill string by employing a method similar to the one described above for separating pipe segments.

DETAILED DESCRIPTION OF THE PREFERRED EMBODIMENT

INVENTION

Figure 1:
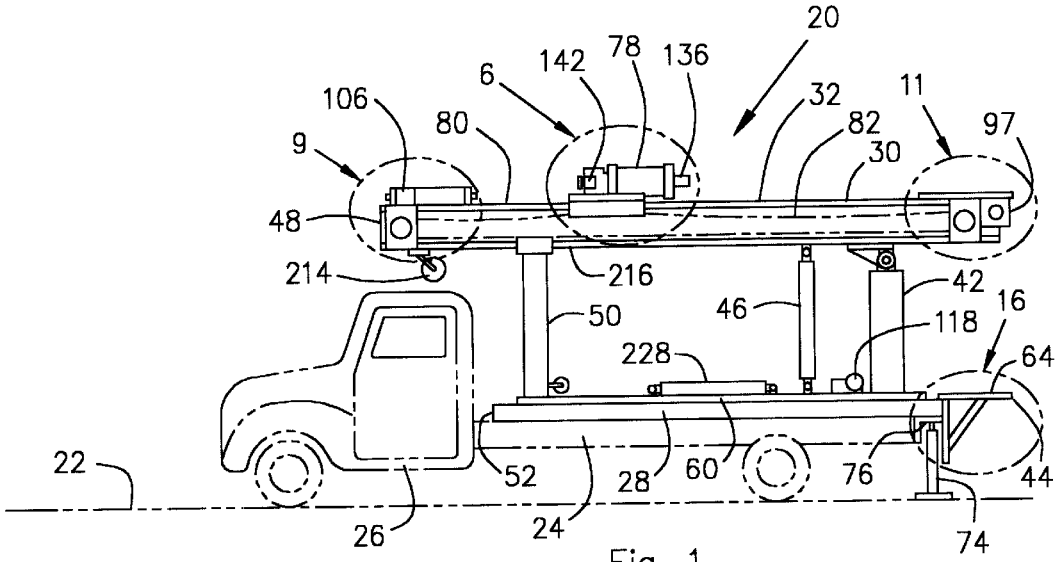
FIG. 1 is a side view of a portable drilling rig constructed in accordance with a preferred embodiment of the present invention, shown mounted on a truck bed.
Figure 2:
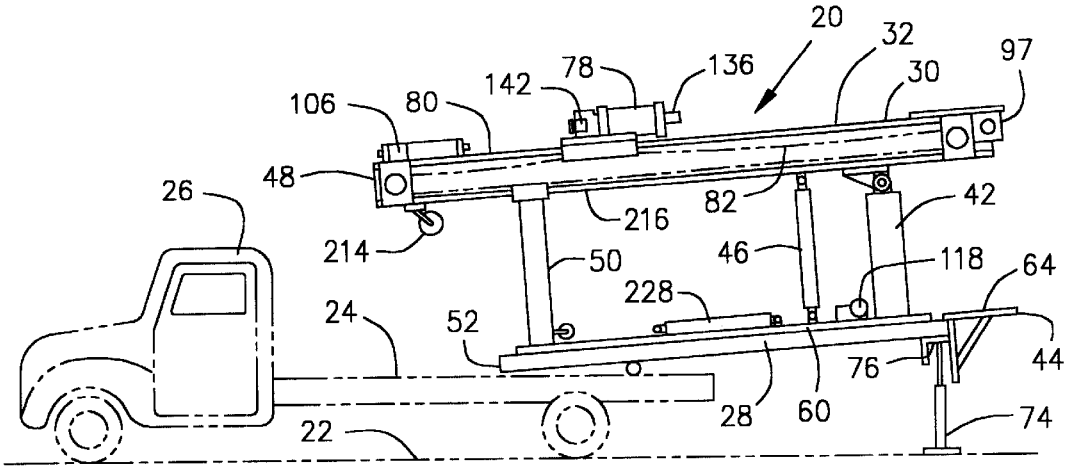
FIG. 2 is a side view of the portable drilling rig of FIG. 1 showing the rear end of the rig raised by jacks and a roller placed between the rig and the truck bed to facilitate the truck driving partially out from under the rig.
Figure 3:
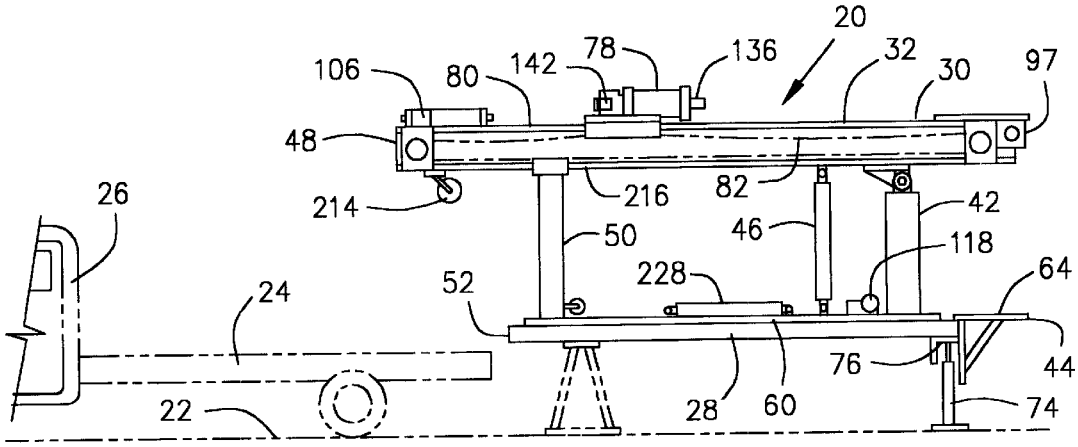
FIG. 3 is a side view of the portable drilling rig of FIG. 2 showing the rig removed from the truck and the front end of the rig resting on a stand.
Figure 4:
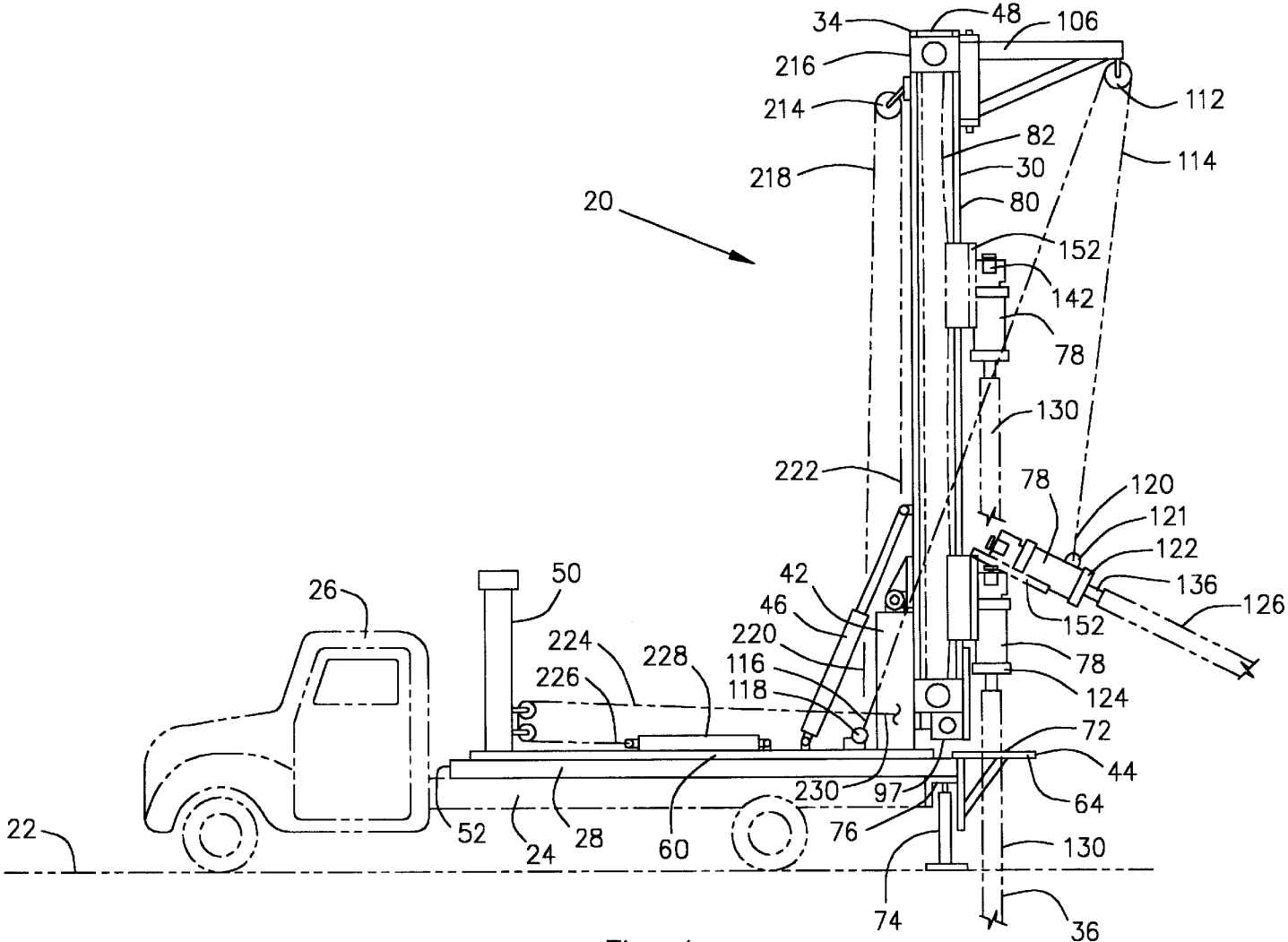
FIG. 4 is a side view of the portable drilling rig of FIG. 1 shown with the mast raised to a vertical position and the swivel shown in three different alternate positions.

Referring now to the drawings and initially to FIG. 1, there is illustrated a portable drilling rig 20 for drilling water wells or installing geothermal pipe systems in the ground 22. As illustrated in FIGS. 1, 2, and 3, the portable drilling rig 20 is removably mounted on a bed 24 of a truck 26 via a supporting frame 28 that holds the rig 20 on the truck bed 24. The rig 20 is provided with a pivotal single I beam mast 30 that can be pivoted downward to a horizontal position 32, as illustrated in FIG. 1, for transport and can be pivoted upward to a vertical position 34, as illustrated in FIG. 4, to drill a vertical bore 36 into the ground 22, or alternately, pivoted upward to a slanted or off-vertical position 38 for drilling an angled bore 40 into the ground 22, as illustrated in FIG. 5.

Figure 5:
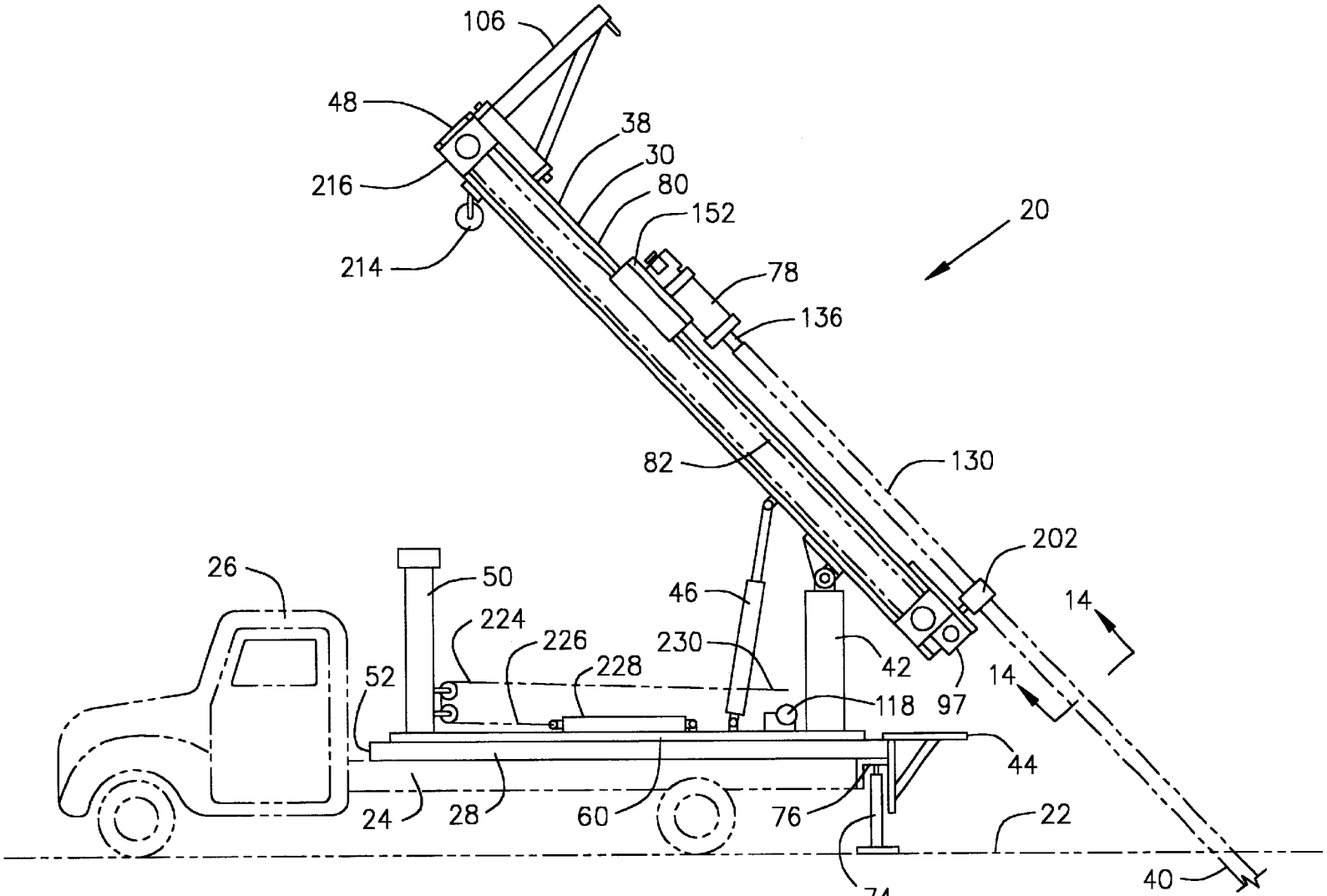
FIG. 5 is a side view of the portable drilling rig of FIG. 4 shown with the mast raised to an inclined position so that and an angled bore can be drilled into the ground.

As illustrated in FIG. 5, the mast 30 is pivotally secured to an upwardly extending, supporting pivot leg 42 provided secured to the frame 28 at a rear end 44 of the drilling rig 20. The mast 30 is raised and lowered by a first hydraulic cylinder 46 that causes the mast 30 to pivot at the supporting pivot leg 42. When the mast 30 is pivoted downward to its horizontal position 32, an upper end 48 of the mast 30 is supported by an upwardly extending, front support leg 50 secured to the frame 28 at the front end 52 of the rig 20.

Figure 23:
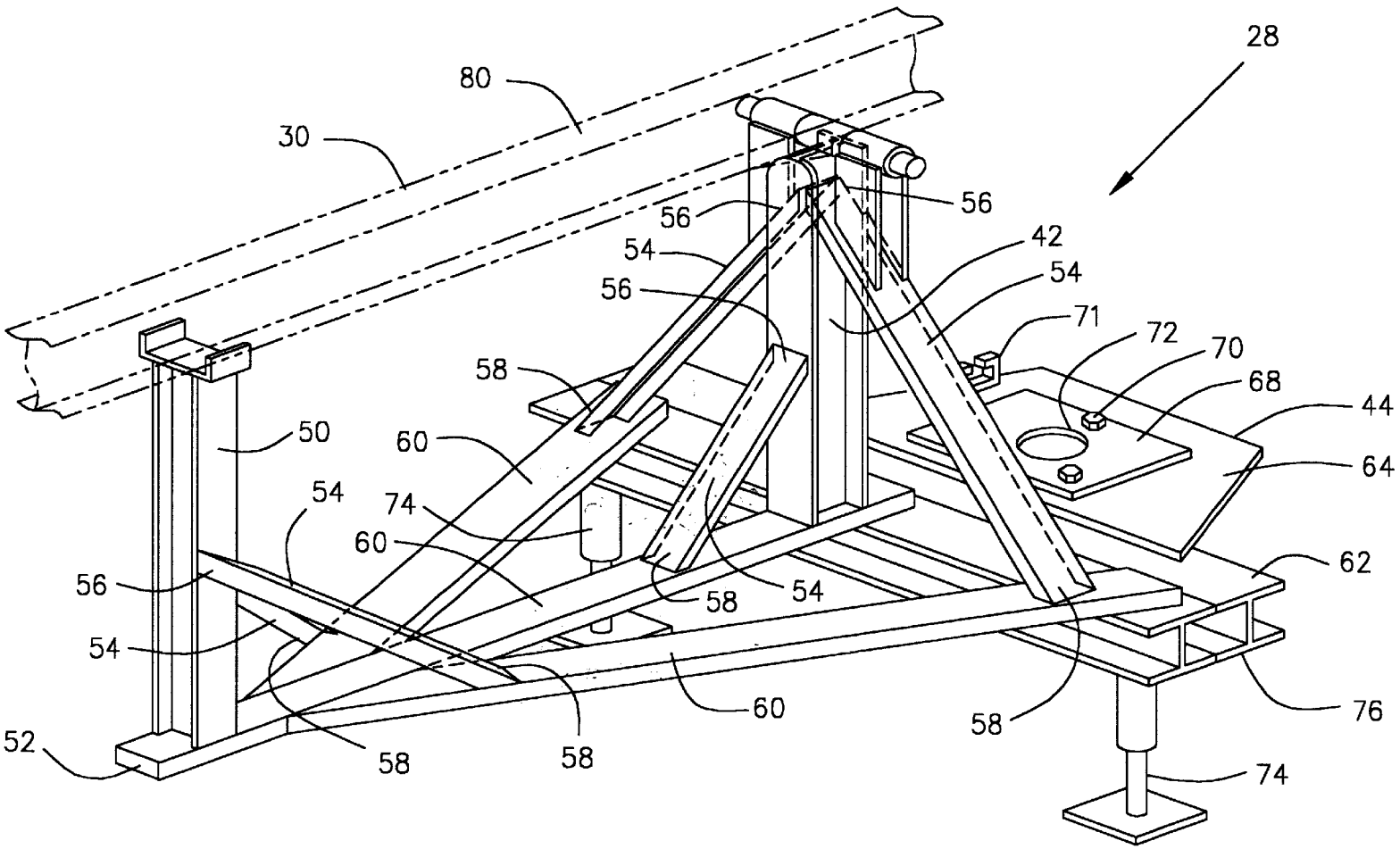
FIG. 23 is a perspective view of the supporting framework for the drilling rig of FIG. 1.

Referring now to FIG. 23, both the support pivot leg 42 and the front support leg 50 are secured in their upright positions by braces 54 that attach on one end 56 of the brace 54 to one of the legs 42 or 50 and that extend downward and attach at an angle on an opposite end 58 of the brace 54 to one of the bottom members 60 of the frame 28, thus forming triangular bracing with the bottom members 60 of the frame 28 for the legs 42 and 50. Also the bottom members 60 of the frame 28 attach to a double I-beam 62 of the frame 28 at the rear end 44 of the rig 20 to form triangular configurations with the double I-beam 62. The triangular configurations of the bottom members 60 and the braces 54 of the frame 28 make it strong.

Figure 17:
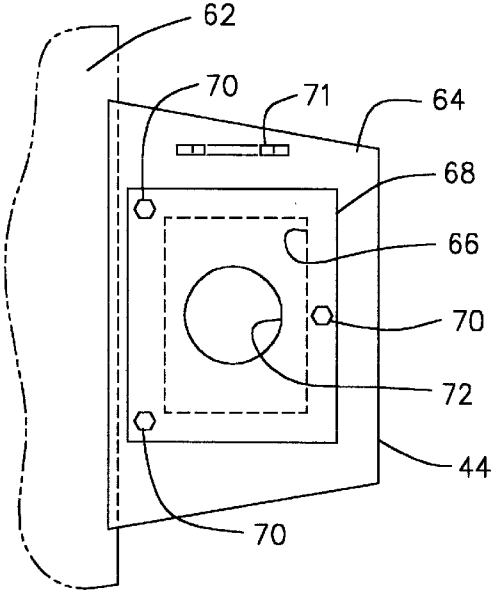
FIG. 17 is a top view of the base plate of FIG. 16, taken along line 17—17.
Figure 16:
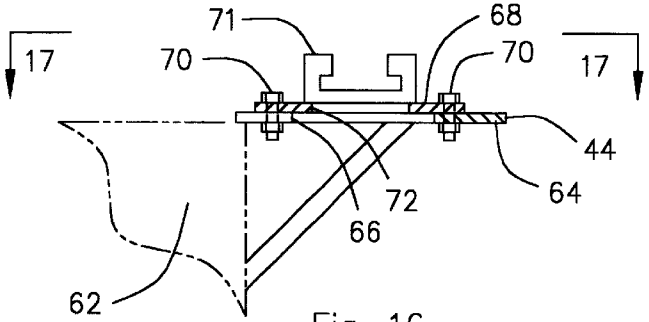
FIG. 16 is an enlarged side view of base plate of the drilling rig included within circle 16 of FIG. 1.

As illustrated in FIGS. 16 and 17, a base plate 64 is secured to the double I-beam 62 provided on the frame 28 at the rear end 44 so that the base plate 64 extends horizontally away from the frame 28. The base plate 64 has a rectangular bit breaker opening 66 therethrough and a removable plate 68 that attaches over the base plate 64 via bolts 70. The base plate 64 is also provided with an upwardly facing "c"-shaped bracket 71 for holding a wrench or other tool to prevent the wrench or tool from rotating when torque is applied to the wrench or tool. The removable plate 68 has a circular shoe opening 72 extending through it. The function of the base plate 64 and the removable plate 68 will be discussed more fully hereafter.

Also, as illustrated in FIGS. 3 and 4, and 5, jacks 74 attach to a lower side 76 of the double I-beam 62. The jacks 74 can be lowered to the ground 22 to help support the frame 28 above the ground 22 either when the rig 20 is being used for drilling or when the rig 20 is removed from the truck bed 24. The jacks 74 can be retracted upward toward the frame 28 when the rig 20 is being transported so that they do not drag on the ground 22.

Figure 8:
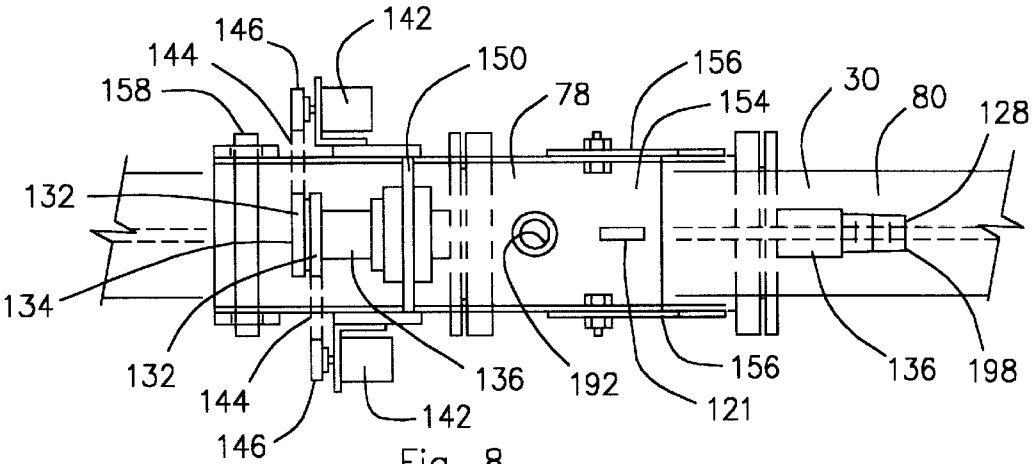
FIG. 8 is a top view taken along line 8—8 of FIG. 6.
Figure 6:
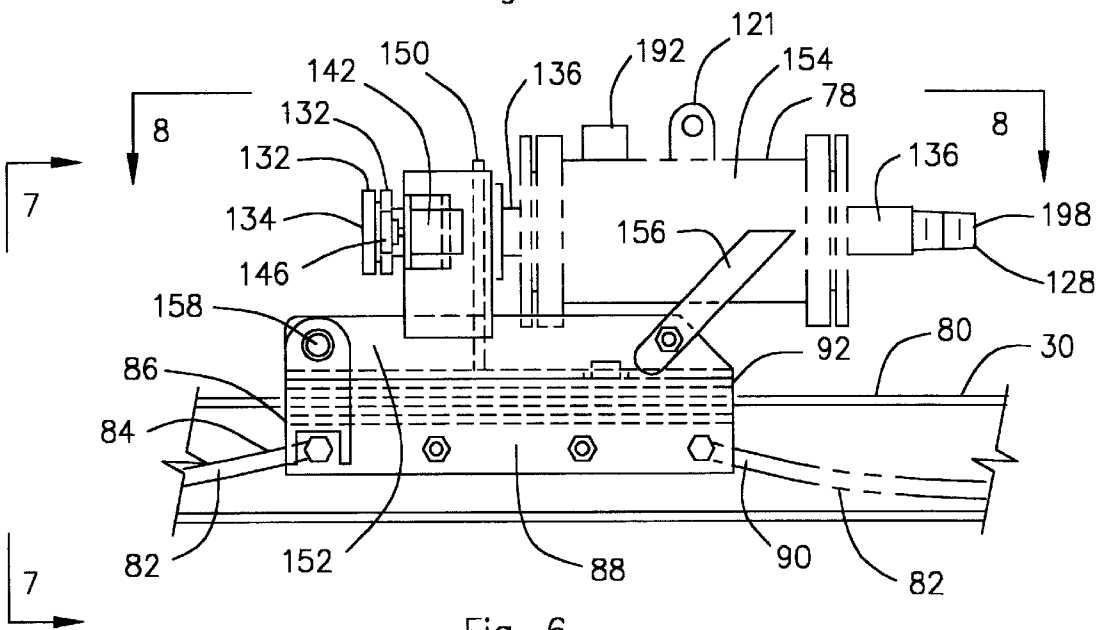
FIG. 6 is an enlarged side view of the swivel located within circle 6 of FIG. 1.
Figure 7:
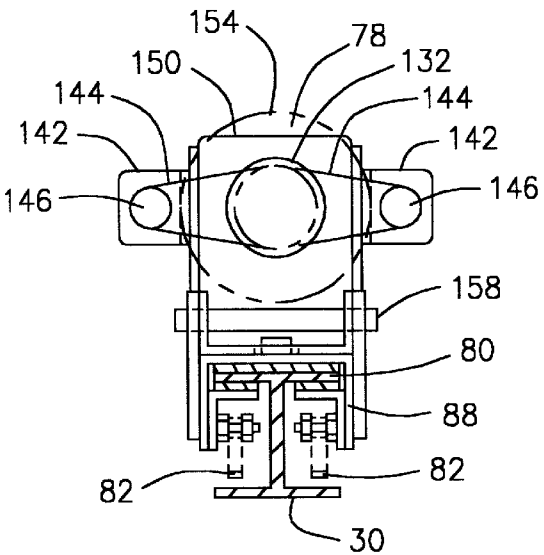
FIG. 7 is a cross sectional view taken along line 7—7 of FIG. 6.
Figure 13:
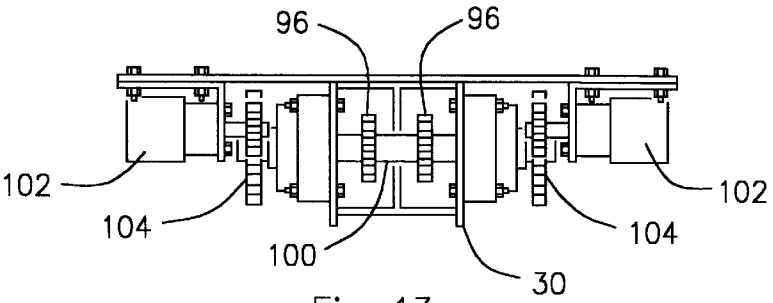
FIG. 13 is an end view of the lower portion of the mast of FIG. 11.
Figure 12:
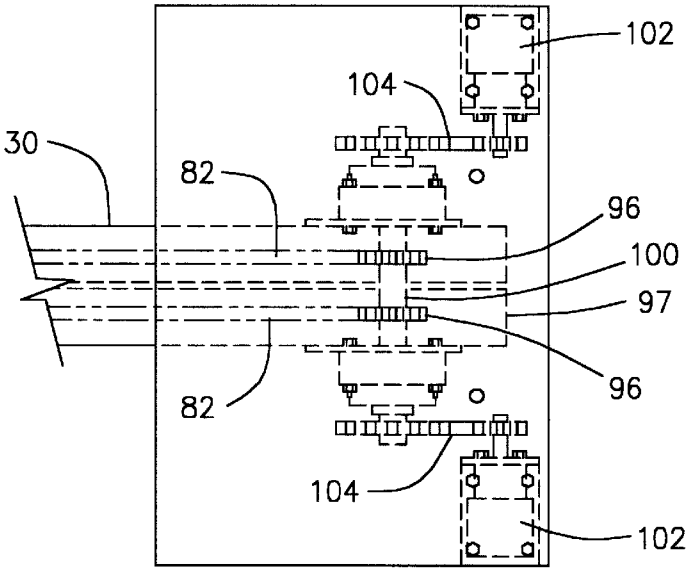
FIG. 12 is a top view of the lower end of the mast of FIG. 11.
Figure 11:
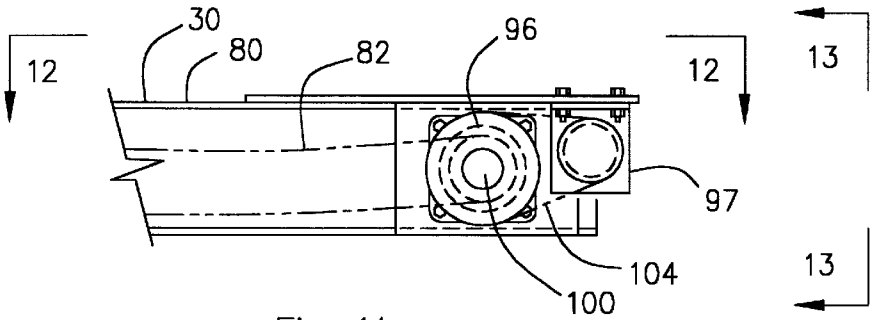
FIG. 11 is an enlarged side view of the lower end of the mast located within circle 11 of FIG. 1.

Referring now to FIGS. 6, 7 and 8, a swivel 78 is movably attached to a back side 80 of the mast 30 via a pair of mast chains 82 so that the swivel 78 can be moved upward on the mast 30 and lowered downward on the mast 30 when the mast 30 is raised from its horizontal position 32. One end 84 of each of the mast chains 82 secures to a top 86 of a non-pivoting portion 88 of the swivel 78 and the other end 90 of each of the mast chains 82 secures to a bottom 92 of the non-pivoting portion 88 of the swivel 78. Each of the mast chains 82 extends over a mast chain sprocket 94 at the upper end 48 of the mast 30, and as illustrated in FIGS. 11, 12, and 13, each of the mast chains 82 extends around a mast drive sprocket 96 at the lower end 97 of the mast 30. The mast chain sprockets 94 provided at the upper end 48 of the mast 30 secure to the mast 30 via a common shaft 98, and the mast drive sprockets 96 at the lower end 97 of the mast 30 secure to the mast 30 via a common shaft 100. A pair of mast chain drive motors 102 provided on the lower end of the mast 30 rotate the mast drive sprockets 96 via a pair of mast motor drive chains 104, thereby raising and lowering the swivel 78.

Figure 10:
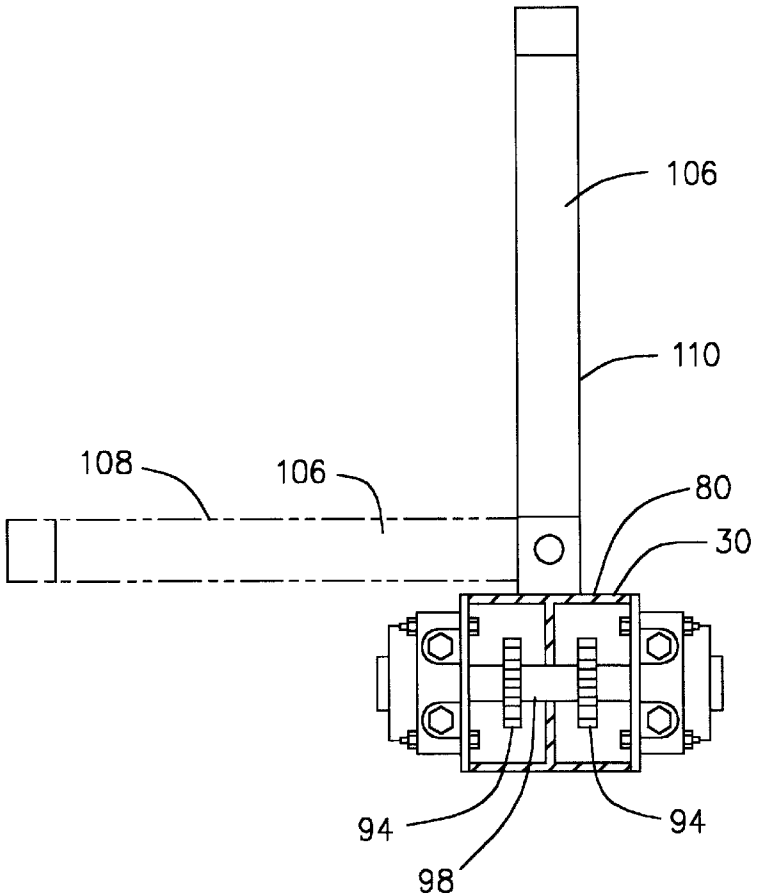
FIG. 10 is a bottom view of the boom line arm of FIG. 9 showing two different positions for the boom line arm.
Figure 9:
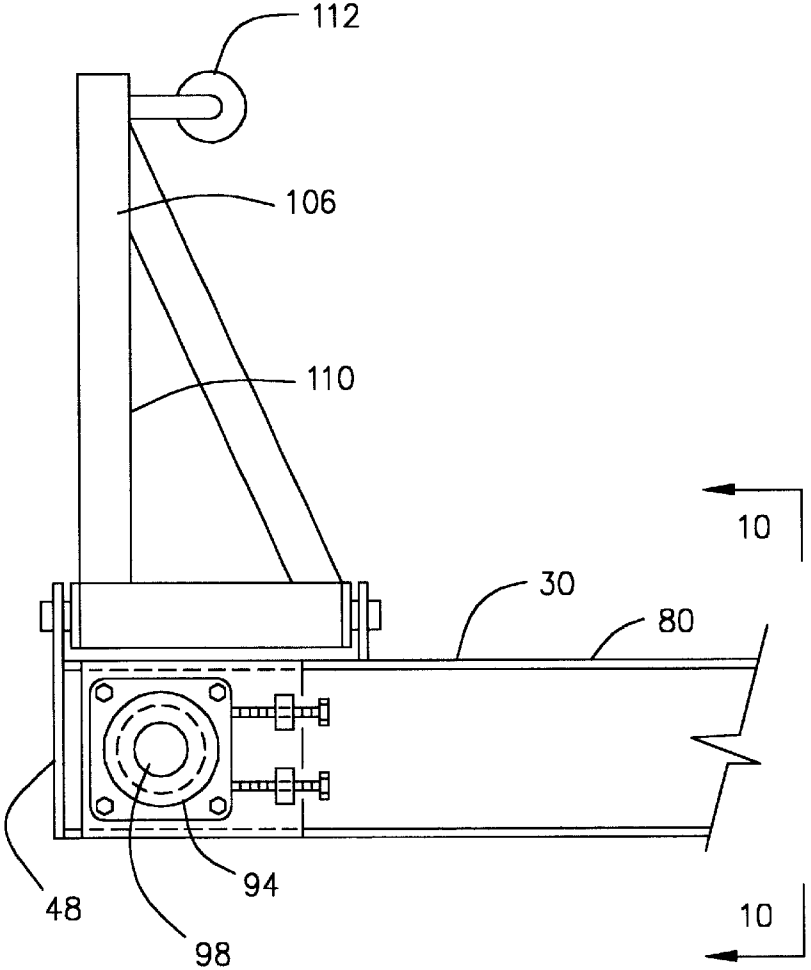
FIG. 9 is an enlarged side view of the upper end of the mast located within circle 9 of FIG. 1, shown with the boom line arm swiveled outward at a right angle from the mast.

As shown in FIGS. 9 and 10, a boom line arm 106 is also pivotally secured to the mast 30 on the upper end 48 of the mast 30. The boom line arm 106 pivots so that it assumes a non-extended position 108 where the boom line arm 106 lies horizontal when the mast 30 is in its horizontal position 32. Also, the boom line arm 106 can be pivoted to an extended position 110 so that the boom line arm 106 extends outward from the rear end 44 of the rig 20 when the mast 30 is raised from its horizontal position 32. The boom line arm 106 is provided with a pulley 112 around which a boom cable 114 runs. The boom cable 114 attaches on one end 116 to a hydraulic winch 118 provided attached to the frame 28 and attaches on an opposite end 120 to an eye 121 provided on the swivel 78. The winch 118 is activated to pivot the swivel 78 by raising the swivel 78 to a non-parallel position 122 where the swivel 78 is non-parallel with the mast 30, and alternately, to lower the swivel 78 back to its original parallel position 124 so that it is parallel with the mast 30.

It is necessary to pivot the swivel 78 upward out of parallel alignment with the mast 30 in order to add pipe segments 126 to a bottom end 128 of the swivel 78 when making up a pipe drill string 130 during drilling operations and also to remove pipe segments 126 from the bottom end 128 of the swivel 78 when pulling and dismantling a pipe drill string 130.

Referring now to FIGS. 6, 7, and 8, the swivel 78 is provided with dual swivel drive sprockets 132 at its top end 134. The dual swivel drive sprockets 132 are secured to a drive shaft 136 via a key 138 that fits into keyways 140 and 141 provided respectively in the drive shaft 136 and in the swivel drive sprockets 132. The drive shaft 136 extends from the top end 134 of the swivel 78, through the swivel 78, and to the bottom end 128 of the swivel 78. Two swivel drive motors 142 are secured to the top end 134 of the swivel 78. The dual swivel drive sprockets 132 are driven by the two swivel drive motors 142 via a pair of swivel drive chains 144. Each of the swivel drive chains 144 engages its associated swivel drive sprocket 132 and a drive motor sprocket 146 provided on its associated swivel drive motor 142 to cause the drive shaft 136 to rotate within the swivel 78 when the rig 20 is being used to drill.

Figure 22:
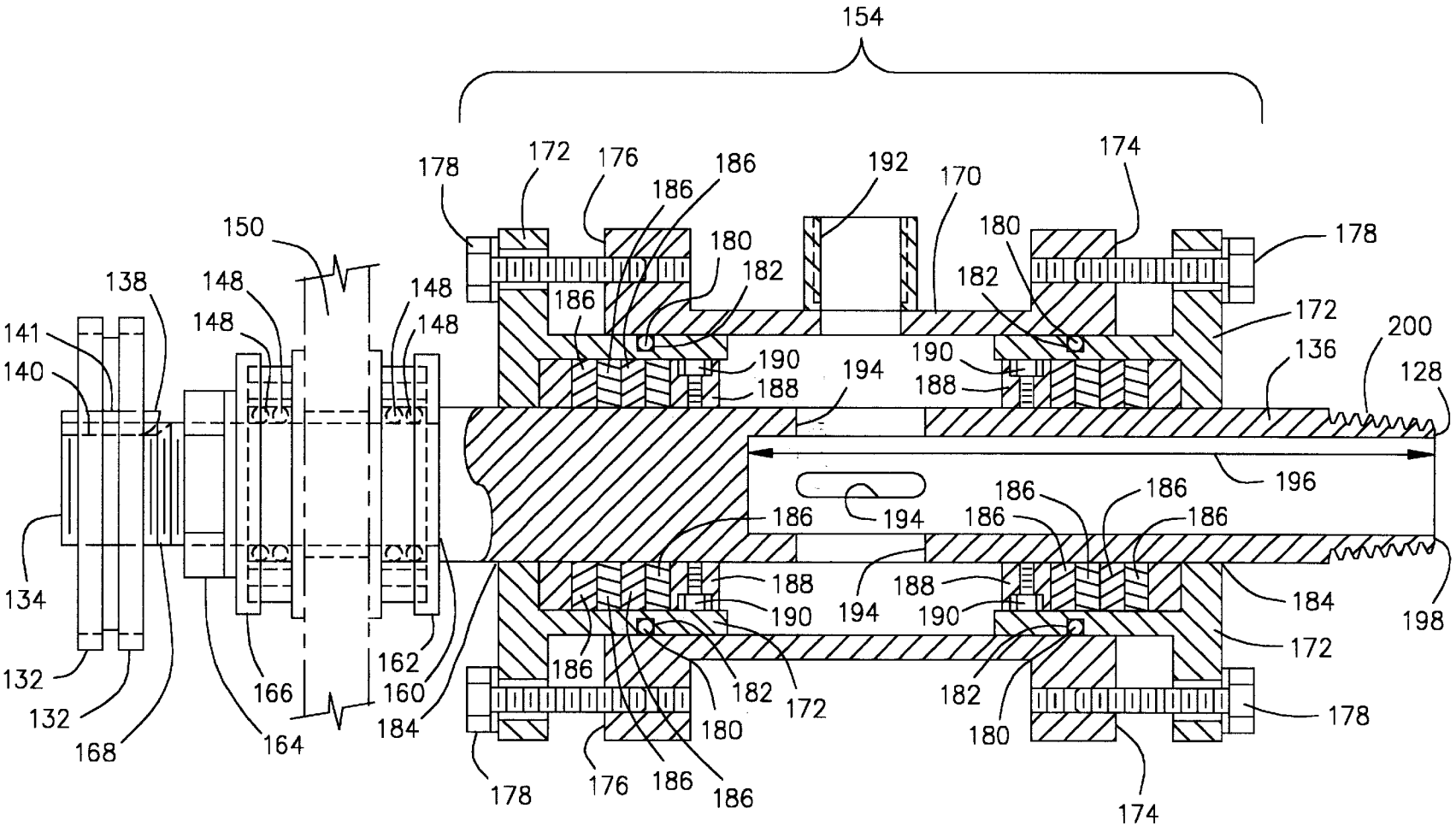
FIG. 22 is a partially cut away view of the swivel of FIG. 8.

Referring also to FIG. 22, the swivel 78 is provided with bearings 148 located adjacent to the dual swivel drive sprockets 132, and the drive shaft 136 rotates within the bearings 148. The bearings 148 attach to a supporting collar 150 that secures to a pivoting member 152. A main body 154 of the swivel 78 also attaches via a support arm 156 to the pivoting member 152 to hold the swivel 78 stationary relative to the pivoting member 152. The pivoting member 152 pivotally attaches via a pivot rod 158 to the non-pivoting portion 88 of the swivel 78.

The pivoting member 152 and the attached swivel 78, as a unit, pivot at the pivot rod 158 to move the swivel 78 from its non-parallel position 122 where the swivel 78 is out of parallel alignment with the mast 30, and alternately, back into its parallel position 124 where the swivel 78 is in parallel alignment with the mast 30, as previously described. The bearings 148 are retained on the drive shaft 136 by a shoulder 160 provided on the drive shaft 136 at a lower end 162 of the collar 150 and by a threaded nut 164 on the other upper end 166 of the collar 150. The threaded nut 164 engages threads 166 provided on the drive shaft 136 on a portion of the drive shaft 136 located adjacent to the dual swivel drive sprockets 132.

The drive shaft 136 extends through a main body 154 of the swivel 78 that is located adjacent to the supporting collar 150 and bearings 148. The main body 154 is comprised of a hollow central cylinder 170 to which an end flange 172 attaches at either end 174 and 176 of the central cylinder 170 via lock bolts 178. The end flanges 172 fit tightly within the central cylinder 170 and an o-ring 180 provided in an o-ring groove 182 in each of the end flanges 172 prevents drilling fluid (not illustrated) from exiting the hollow central cylinder 170 by preventing the fluid from travelling between the end flange 172 and the hollow central cylinder 170 where they join together.

Each end flange 172 has a drive shaft opening 184 in it and through which the drive shaft 136 extends. Several gland packing rings 186 are provided internally in the main body 154 adjacent to each of the end flanges 172. A brass ring 188 is provided adjacent to each set of gland packing rings 186. Each brass ring 188 secures to the drive shaft 136 via screws 190 so that the gland packing rings 186 are sandwiched between their end flange 172 and their associated brass ring 188. Distance between a brass ring 188 and its associated end flange 172 can be decreased by tightening the lock bolts 178 in order to compress the gland packing rings 186 so that they tighten around the drive shaft 136. The gland packing rings 186 prevent drilling fluid from exiting the main body 154 via the drive shaft openings 184 in the end flanges 172.

The central cylinder 170 is provided with a fluid inlet opening 192 for admitting drilling fluid into the hollow main body 154 of the swivel 78. The drive shaft 136 is provided with several fluid openings 194 that communicate through the drive shaft 136. The fluid openings 194 are provided in a portion of the drive shaft 136 that is located within the hollow main body 154 of the swivel 78. Each of these fluid openings 194 extends through the drive shaft 136 into a hollow segment 196 of the drive shaft 136. The hollow segment 196 of the drive shaft 136 is continuous with the lower end 198 of the drive shaft 136 so that the drive shaft 136 is hollow as it terminates at the bottom end 128 of the swivel 78. The lower end 198 of the drive shaft 136 is provided with male threads 200 for removable engagement with mating female threads (not illustrated) provided on pipe segments 126. Thus, drilling fluid flows into the hollow main body of the swivel 78 via the inlet opening 192, then into the hollow segment 196 of the drive shaft 136 via the fluid openings 194 in the drive shaft 136, and from there into the hollow interior of the pipe segments 126 comprising the pipe drill string 130.

Figure 15:
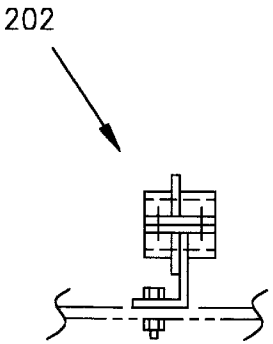
FIG. 15 is a side view of the guide plate for angled drilling taken along line 15—15 of FIG. 14.
Figure 14:
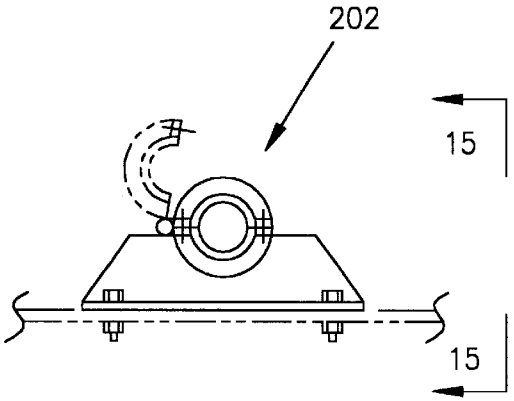
FIG. 14 is an enlarged cross sectional view of the guide plate for angled drilling taken along line 14—14 of FIG. 5.

As shown in FIG. 5, when the drilling rig 20 is placed in a slanted position 38 so that it can be used to drill an angled bore 40 into the ground 22, a guide plate 202 is removably secured to a lower end 97 of the mast 30. As illustrated in FIGS. 14 and 15, the guide plate 202 opens up so that it can extend around the pipe drill string 130 to help support the pipe drill string 130 and to hold it at the proper angle "A" relative to the ground 22 when drilling an angled bore 40.

Figure 20:
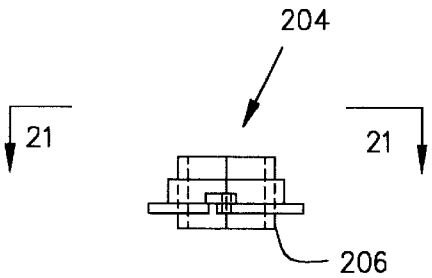
FIG. 20 is a removable guide shoe for a drill pipe used in association with the base plate of FIGS. 16 and 17 when the drilling rig is used to drill a vertical bore into the ground.
Figure 21:
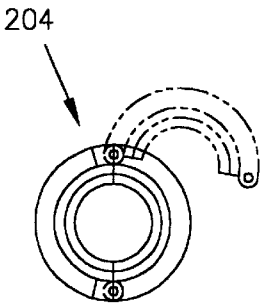
FIG. 21 is a top view of the removable guide shoe of FIG. 20 showing the guide plate alternately in an open position and in a closed position.

When the drilling rig 20 is placed in its vertical position 34 so that it can be used to drill a vertical bore 36 into the ground 22, a specially designed guide shoe 204 is placed around the pipe drill string 130. As shown in FIGS. 20 and 21, two halves of the guide shoe 204 swing opens to facilitate attaching and removing it from the pipe drill string 130. As illustrated in FIGS. 20 and 21, the guide shoe 204 has a downwardly extending lip 206 that inserts within the shoe opening 72 provided in the base plate 64, thus allowing the base plate 64 to help keep the pipe drill string 130 in approximately vertically alignment during drilling. As shown in FIGS. 16 and 17, the shoe opening 72 is provided in a removable plate 68 attached via bolts 70 to the base plate 64. The removable plate 68 can be removed to reveal a bit breaker opening 66, as will be discussed hereafter.

Figure 18:
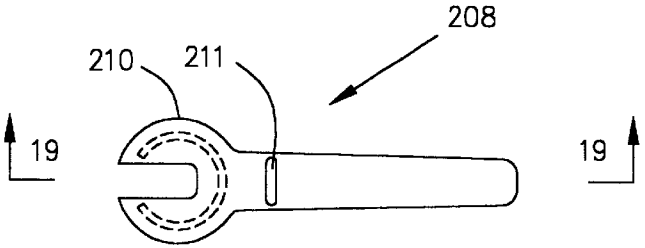
FIG. 18 is a backup wrench that is used in association with the base plate of FIGS. 16 and 17 to break pipe loose from the drill sting.
Figure 19:
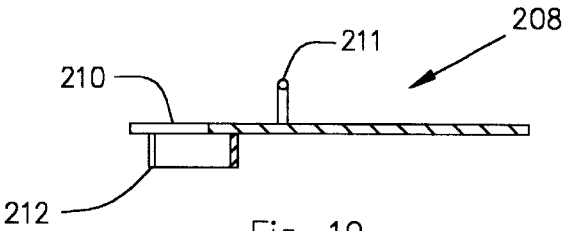
FIG. 19 is a cross sectional view of the backup wrench of FIG. 18 taken along line 19—19.

Pipe segments 126 of the pipe drill string 130 must be broken apart from each other to either add pipe segments 126 to the pipe drill string 130 or to remove pipe segments 126 from the pipe drill string 130. In order to break the pipe segments 126 apart, the guide shoe 204 is first removed from the pipe drill string 130. Next, a specially designed backup wrench 208 is inserted around the pipe segment 126 so that the u-shaped head 210 of the backup wrench 208 engages a flat portion (not illustrated) provided on each end of the pipe segment 126. The backup wrench is illustrated in FIGS. 18 and 19. The backup backup wrench 208 is provided with an upwardly extending loop shaped handle 211 for ease in lifting the backup wrench 208. A downwardly extending lip 212 provided on the specially designed backup wrench 208 is next inserted into the shoe opening 72 in the base plate 64.

Then a traditional pipe-breaking wrench (not illustrated) is employed to grasp a portion (not illustrated) on the end of the adjacent pipe segment 126. In order for the operator to handle a heavy traditional pipe-breaking wrench (not illustrated), a pulley 214 is provided on the front side 216 of the mast 30 and a wrench cable 218 runs through the pulley 214. One end 220 of the wrench cable 218 removably attaches to the winch 118 that is attached to the frame 28 and an opposite second end 222 of the wrench cable 218 removably attaches to the traditional pipe breaking wrench (not illustrated) to assist the operator in lifting, positioning and holding the heavy pipe-breaking wrench (not illustrated).

As illustrated in FIG. 4, a cable 224 that attaches on a first end 226 to a second hydraulic cylinder 228 can be attached on its second end 230 to the traditional pipe-breaking wrench (not illustrated) in order to provide the necessary torque to break the pipe segments 126 apart so that they can be unthreaded from each other.

When it is necessary to remove a drilling bit (not illustrated) from the pipe drill string 130, the removable plate 68 is removed from the base plate 64 to reveal the bit breaker opening 66 provided in the base plate 64. The bit breaker opening 66 is employed for holding a bit breaker tool (not illustrated). The bit breaker tool (not illustrated) is used to hold the drilling bit (not illustrated) so that it does not rotate relative to the base plate 64. This is necessary when the drilling bit (not illustrated) is disengaged from the pipe drill string 130 by employing a method similar to the one described above for separating pipe segments 126.

Although the invention has been described as being hydraulic powered and using chain drives and sprockets, the invention is not so limited. Other types of power can be used to drive the drilling rig 20 and planetary drive hydraulic motor or motors may be used instead of the hydraulic motors that have been described.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A portable drilling rig comprising:

a mast constructed of a single I-beam, said mast pivotally secured to a frame so the mast can be pivoted between a horizontal position relative to the frame and a vertical position relative to the frame, said frame removably attached to a truck bed, a swivel movably secured to said mast so that the swivel moves parallel to said mast, a pair of chain drives functionally attached to said swivel, one of the pair of chain drives provided on either side of the I-beam, each of the pair of chain drives extending the length of the I-beam, a drive motor engaging each said chain drive as a means of moving the chain drive and said swivel relative to the mast, said swivel pivotally attached to said mast so said swivel can be pivoted out of parallel alignment with the mast and back into parallel alignment with the mast, a drive shaft extending through said swivel, a lower end of said drive shaft provided with threads for removably engaging threads on segments of pipe that collectively form a pipe drill string, and means for rotating said drive shaft provided on the top of said swivel in order to rotate the attached pipe drill string and a drill bit that is attached at a lower end of the pipe drill string, an inlet opening provided on the side of the swivel for admitting fluid to the interior of the swivel, and sides of said drive shaft being provided with inlet holes extending therethrough to allow fluid to enter the drive shaft from the interior of the swivel.

2. A portable drilling rig according to claim 1 further comprising:

a supporting pivot leg attached to said frame, said mast pivotally attached to said supporting pivot leg, and a first cylinder for raising and lowering said mast relative to said frame.

3. A portable drilling rig according to claim 2 further comprising:

a guide plate removably secured to a lower end of said mast for removably receiving a pipe drill string in order to hold the pipe drill string when drilling an angled hole in the ground.

4. A portable drilling rig according to claim 2 further comprising:

a base plate secured to a rear end of the frame so that the base plate extends horizontally outward from the frame, said base plate provided with a bit breaker opening extending therethrough, a bracket secured to the base plate for preventing rotation of tools relative to the base plate, and a removable plate secured to said base plate, and said removable plate provided with a shoe opening extending therethrough.

5. A portable drilling rig according to claim 4 further comprising:

a guide shoe with a lip for removable engagement with a pipe drill string, said guide shoe provided with a lip for removable engagement with the shoe opening in said removable plate.

6. A portable drilling rig according to claim 2 further comprising:

jacks secured to a rear end of the frame, said jacks removably engagable with the ground for supporting the frame during drilling and when the frame is removed from a truck bed.

7. A portable drilling rig according to claim 2 further comprising:

a boom line arm pivotally attached to a upper end of the mast so that the boom line arm can be pivoted to a non-extended position to the side of the mast for transport and pivoted to an extended position to the back side of the mast for drilling, a pulley provided on the boom line arm, a boom arm cable engaging said pulley, one end of said boom arm cable attaching to a winch provided on the frame and a second end of said boom arm cable removably attaching to said swivel as a means of pivoting the swivel out of parallel alignment relative to the mast and pivoting the swivel back into parallel alignment relative to the mast.

8. A portable drilling rig according to claim 1 further comprising:

a base plate secured to a rear end of the frame so that the base plate extends horizontally outward from the frame, said base plate provided with a bit breaker opening extending therethrough, a bracket secured to the base plate for preventing rotation of tools relative to the base plate, and a removable plate secured to said base plate, and said removable plate provided with a shoe opening extending therethrough, a supporting pivot leg attached to said frame, said mast pivotally attached to said supporting pivot leg, and a first cylinder for raising and lowering said mast relative to said frame.

9. A portable drilling rig according to claim 8 further comprising:

a guide shoe with a lip for removable engagement with a pipe drill string, said guide shoe provided with a lip for removable engagement with the shoe opening in said removable plate.

10. A portable drilling rig according to claim 8 further comprising:

a guide plate removably secured to a lower end of said mast for removably receiving a pipe drill string in order to hold the pipe drill string when drilling an angled hole in the ground.

11. A portable drilling rig according to claim 8 further comprising:

jacks secured to a rear end of the frame, said jacks removably engagable with the ground for supporting the frame during drilling and when the frame is removed from a truck bed.

12. A portable drilling rig according to claim 8 further comprising:

a boom line arm pivotally attached to a upper end of the mast so that the boom line arm can be pivoted to a non-extended position to the side of the mast for transport and pivoted to an extended position to the back side of the mast for drilling, a pulley provided on the boom line arm, a boom arm cable engaging said pulley, one end of said boom arm cable attaching to a winch provided on the frame and a second end of said boom arm cable removably attaching to said swivel as a means of pivoting the swivel out of parallel alignment relative to the mast and pivoting the swivel back into parallel alignment relative to the mast.

13. A portable drilling rig according comprising:

a mast constructed of a single I beam, said mast pivotally secured to a frame so the mast can be pivoted between a horizontal position relative to the frame and a vertical position relative to the frame, a slide holding a drilling head movably secured to said mast so that the slide moves parallel to said mast, a pair of chain drives functionally attached to said slide, one of the pair of chain drives provided on either side of the I beam, each of the a pair of chain drives extending the length of the I beam, a drive motor engaging said chain drive as a means of moving the chain drive and said drilling head relative to the mast, said drilling head pivotally attached to the slide so that the slide can be pivoted out of parallel alignment with the mast and pivoted back into parallel alignment with the mast, a drive shaft supported at the upper part by two bearings, one bearing provided on each side of a plate fixed approximately perpendicular on the slide, the shaft extending down through a fluid containment chamber that is attached to the slide for support of the lower part of said drive shaft, the bottom end of the drive shaft removably engaging threads for attaching segments of pipe that collectively form a drill pipe string, power for rotating the drill pipe string being supplied by at least one motor, the fluid containment chamber attached to the slide being provided with a side opening for admitting fluid to the interior of the chamber, sides of said drive shaft being provided with inlet holes extending therethrough to allow fluid to enter the drive shaft from the interior of the fluid containment chamber, and said drive shaft continuous with the drill pipe string so that fluid moves through the drive shaft to reach the drill bit located at the end of the drill pipe string.

* * * * *